US005323597A

United States Patent [19]

Yamada et al.

[11] Patent Number: 5,323,597

[45] Date of Patent: Jun. 28, 1994

[54] SYTEM FOR EXCHANGING ROVING BOBBINS APPLIED TO A RING SPINNING FRAME

[75] Inventors: Koichi Yamada; Kanehiro Ito, both of Aichi; Shinji Kato, Nagoya, all of Japan

[73] Assignee: Howa Machinery, Ltd., Aichi, Japan

[21] Appl. No.: 891,930

[22] Filed: Jun. 1, 1992

Related U.S. Application Data

[63] Continuation of Ser. No. 629,562, Dec. 18, 1990, abandoned.

[30] Foreign Application Priority Data

Dec. 22, 1989 [JP] Japan ..... 1-333997

[51] Int. Cl.[5] ..... D01H 9/18; D01H 9/00

[52] U.S. Cl. ..... 57/281; 57/278; 242/131

[58] Field of Search ..... 57/281, 90, 261, 278; 242/131

[56] References Cited

U.S. PATENT DOCUMENTS

| | | | |
|---|---|---|---|
| 3,828,682 | 8/1974 | Klein | 57/281 X |
| 3,935,821 | 2/1976 | Maier et al. | 57/281 X |
| 4,464,893 | 8/1984 | Zingel | 57/267 |
| 4,464,894 | 8/1984 | Zingel | 57/267 |
| 4,473,997 | 10/1984 | Kawasaki et al. | 57/281 X |
| 4,735,042 | 4/1988 | Igel | 57/281 |
| 4,799,353 | 1/1989 | Kawasaki et al. | 57/281 |
| 4,827,709 | 5/1989 | Schoeller et al. | 57/281 |
| 4,841,720 | 6/1989 | Kawasaki et al. | 57/281 |

FOREIGN PATENT DOCUMENTS

| | | |
|---|---|---|
| 50-76341 | 6/1975 | Japan . |
| 50-89642 | 7/1975 | Japan . |
| 56-12256 | 2/1981 | Japan . |
| 57-43498 | 9/1982 | Japan . |
| 58-81631 | 5/1983 | Japan . |
| 59-1733 | 1/1984 | Japan . |
| 60-14848 | 4/1985 | Japan . |
| 62-263332 | 11/1987 | Japan . |
| 63-29016 | 6/1988 | Japan . |
| 63-256728 | 10/1988 | Japan . |

*Primary Examiner*—Joseph J. Hail, III
*Assistant Examiner*—John F. Rollins
*Attorney, Agent, or Firm*—Stevens, Davis, Miller & Mosher

[57] ABSTRACT

A bobbin exchange system applied to a ring spinning frame provided with a unique creel mechanism, wherein a pair of parallel rails is provided for supporting respective bobbin carriages. Each bobbin carriage is provided with two alignments of bobbin hangers, to a number which is identical to a number of spindles of each side of the ring spinning frame. When roving bobbins supported by the bobbin carriage supported by one of the above-mentioned supporting rails reach an almost exhausted condition, a roving bobbin exchange operation between full packaged roving bobbins suspended by the corresponding bobbin hangers of the other bobbin carriage supported by another supporting rail is carried out, and upon completion of the above-mentioned roving bobbin exchange operation, the first-mentioned bobbin carriage is discharged from the first-mentioned supporting rail and then a fresh bobbin carriage supporting full packaged roving bobbins is introduced into the first-mentioned supporting rail by means of a conventional bobbin carriage transporting system. The above-mentioned roving bobbin exchange operation is repeated between the above-mentioned two supporting rails without stopping the spinning operation.

4 Claims, 6 Drawing Sheets

SYTEM FOR EXCHANGING ROVING BOBBINS APPLIED TO A RING SPINNING FRAME

This application is a continuation of application Ser. No. 07/629,562, filed Dec. 18, 1990 now abandoned.

BACKGROUND OF THE INVENTION

1. Field of the Invention

The present invention relates to a system for exchanging almost exhausted roving bobbins with full packaged roving bobbins in a ring spinning frame.

2. Description of the Related Art

Several methods of carrying out an exchange of almost exhausted roving bobbins with full packaged roving bobbins applied to the conventional ring spinning frame have been proposed. For example, Unexamined Japanese Patent Publication Sho 50(1975)-76341 discloses such a method. (Hereinafter referred to as a first method). To carry out the first method of exchanging roving bobbins in the conventional ring spinning frame, a transporting pallet provided with a plurality of bobbin hangers arranged in twin parallel alignments is displaceably mounted on a transporting rail disposed at a creel position of the ring spinning frame. In this first method, first, full packaged roving bobbins are held by the bobbin hanger of the transporting pallet, and the spinning operation of the ring spinning frame provided with a plurality of draft units is started by feeding rovings from the respective full packaged roving bobbins of the transporting pallets which have been positioned at the creel position of the ring spinning frame. Then when the roving bobbins reach an exhausted condition, the driving of the ring spinning frame is stopped, then the another transporting pallet provided with full packaged roving bobbins is introduced onto the transporting rail at the creel position, and after discharging the transporting pallet holding exhausted roving bobbins from the transporting rail at the creel position, the rovings from the full packaged roving bobbins are then introduced to the corresponding draft units, and the spinning operation is started again.

The Japanese Examined Patent Publication Sho 60(1985)-14848 discloses another method of carrying out the roving bobbin exchange operation which is applied to the conventional ring spinning frame. This method is hereinafter referred to as the second method. In the invention disclosed by the above-mentioned publication, to carry out the second method of exchanging the roving bobbins, a transportation rail is arranged at a position outside the twin parallel alignment of bobbin hangers which was arranged at the creel position of the spinning frame, at both sides thereof, and a bobbin carriage provided with a plurality of bobbin hangers, to a number which is not less than the number of bobbin hangers of the above-mentioned twin alignments of the bobbin hangers, is displaceably mounted on the transportation rail. In this method, the spinning operation of the ring spinning frame is started when half exhausted rovings are held by the bobbin hangers of the back side (inside) alignments of the bobbin hangers and full packaged roving bobbins are held by the bobbin hangers of the front side (outside) alignments of the bobbin hangers, in a condition such that a taper effect is obtained between the above-mentioned twin alignments of bobbin hangers, and when the half exhausted roving bobbins reach an almost exhausted condition, while the full packaged roving bobbins reach an almost half exhausted condition, the almost exhausted roving bobbins are exchanged with the full packaged roving bobbins of the bobbin carriage, while rovings from the respective almost exhausted roving bobbins are severed so that free ends of rovings to be feed to the respective draft units of the roving frame are created, and these free ends of the respective rovings are pieced with the corresponding free ends of rovings from the respective full packaged roving bobbins. Immediately after or before this operation of exchanging roving bobbins, the bobbin hangers positioned in the front side alignment are exchanged with the bobbin hangers positioned in the backside alignment. As mentioned above, in this method, the roving bobbin exchange operation is carried out between one of the twin alignments of the bobbin hangers with the bobbin hangers on the bobbin carriage.

Japanese Unexamined Patent Publication Sho 63(1988)-256728 disclosed another method of exchanging the roving bobbins applied to the conventional ring spinning frame. This type of method of carrying out the roving bobbin exchange operation is hereinafter referred to as the third method. In the third method, each side of a spinning frame is provided with at least three creel positions, each creel position is capable of supporting a member provided with a plurality of bobbin hangers in alignment. For a better understanding of the third method, the embodiment disclosed in the specification of this invention is hereinafter explained. Each member can be transported between a roving room and a spinning room, and any combination of two creel positions are always occupied by the above-mentioned member holding roving bobbins for supplying rovings to the respective draft units, in such a way that the rovings from the roving bobbins of one of the above-mentioned two members are supplied to the corresponding draft units, which are alternate draft units from one end of the arrangement of the draft units, while the rovings from the roving bobbins held by the other one of the above-mentioned two members are supplied to the respective draft units, which are the draft units other than the above-mentioned draft units of the identical side of the spinning frame. In other words, the first and second members supply rovings to half of the draft units of the one side of the spinning frame, alternately. Regarding the other creel position which can be any one of the above-mentioned three creel positions, the above-mentioned combination of two members is maintained in a condition to receive a member holding a number of full packaged roving bobbins which is identical to the number of first and second members. To carry out the third method of exchanging roving bobbins, the first member held roving bobbins having a smaller size than the roving bobbins held by the second member, whereby a taper effect is applied between the above-mentioned two members. During the spinning operation, when the roving bobbins having the smaller size reach an almost exhausted condition, the rovings from the almost exhausted roving bobbins are severed so that a free end is created of each roving being fed to the corresponding one of the draft units, and then the above-mentioned free end of each roving is pieced with an end of a roving from the corresponding one of the full packaged roving bobbins held by the third member. Therefore, in the third method, the roving bobbin exchange operation is carried out between either one of the above-mentioned two members and the above-mentioned third member, without stopping the spinning operation.

As explained in the first-mentioned prior art, the method and apparatus for transporting the bobbin carriage along the overhead transporting rail is well known in the prior art. Besides the disclosure of the first-mentioned prior art, in the disclosure of Japanese Examined Patent Publication Sho 63(1988)-29016 and Japanese Unexamined Patent Publication Sho 62(1987)-263332, a battery car is utilized to displace the bobbin carriage along the transporting rail, and thus provide useful technical information as to the state of the art at the time of the present invention.

In the experience of the present inventors, the above-mentioned three methods for exchanging roving bobbins have respective problems which should be solved.

Namely, the first method has an advantage such that the almost exhausted roving bobbins of twin alignments arranged at the creel position can be exchanged with the full packaged roving bobbins at one time, but a drawback arises in that the above-mentioned roving bobbin exchange operation must be carried out after stopping the driving of the spinning frame, and thus the productivity of the ring spinning frame is lowered.

The second method has an advantage such that the roving bobbin exchange operation can be carried out without stopping the driving of the roving frame. Nevertheless, it is necessary to use an apparatus for exchanging the exhausted roving bobbins with the full packaged roving bobbins and an apparatus for exchanging the relative position of the front side alignment of the bobbin hangers and the back side alignment of the roving bobbins, and accordingly, an increase of the installation cost for these apparatuses is inevitable. Moreover, in this method, it is essential to position the roving bobbins in a tapered arrangement between the twin alignments of roving bobbins at the creel position, and therefore, when it is necessary to change the kind of yarns produced by the spinning frame, the preparation of roving bobbins on these bobbin hangers becomes difficult, and further, if various kinds of yarn on a small production scale are to be produced, the above-mentioned problem becomes serious.

On the other hand, the third method, has an advantage in that the roving bobbin exchange operation can be carried out without stopping the driving of the spinning frame, but since the tapered arrangement of the roving bobbins between at least twin alignments of bobbin hangers is essential, the problem arising when the kind of yarn to be produced is changed, which is similar to the problem of the second method mentioned above, still remains.

BRIEF EXPLANATION OF THE PRESENT INVENTION

The object of the present invention is to provide a unique system for exchanging almost exhausted roving bobbins with full packaged roving bobbins, which can be effectively applied to the conventional ring spinning frame, provided with plurality of draft units aligned at each side and along the lengthwise direction thereof, by which the above-mentioned problems can be solved.

The improved system for exchanging the almost exhausted roving bobbins with full packaged roving bobbins, applied to a ring spinning frame according to the present invention, is characterized by functioning in combination with a ring spinning frame provided with a creel mechanism and bobbin carriages provided with twin parallel alignments of bobbin hangers, which are capable of being introduced into and discharged from the creel mechanism, and means for carrying out a roving piecing operation during the roving bobbin exchange operation, and further, means for transporting the above-mentioned bobbin carriages.

Each ring spinning frame to which the present invention is applied, is provided with a creel mechanism characterized by a pair of transporting rails arranged in parallel alignment to the lengthwise direction of the spinning frame, at the creel position at each side of the ring spinning frame. The ring spinning frame is also provided with a plurality of roving guides at a creel position, for leading rovings from the roving bobbins held by the respective bobbin hangers of the outside and inside alignments to the corresponding draft units. This guide means can be disposed in the bobbin carriage, instead of being rigidly fixed to the ring spinning frame at the creel position, if the above-mentioned condition can be satisfied when the bobbin carriage is positioned at one of the transporting rails of the ring spinning frame. To carry out the piecing operation between a roving from a full packaged roving bobbin and an almost exhausted roving bobbin during the roving exchange operation, smoothly and without damaging the rovings introduced from these roving bobbins, the roving guide is provided with a particular shape which will be described in the explanation of the preferred embodiment of the present invention.

On the other hand, the transporting mechanism utilized for this system comprises an overhead transporting rail arranged between a roving room, where a plurality of roving frames are installed, and a spinning room where a plurality of ring spinning frames are applied. The present system is also provided with means for selectively connecting the overhead transporting rail with the creel mechanism of a particular ring spinning frame at which the roving bobbin exchange operation is required. The number of bobbin hangers held by each bobbin carriage is not less than the number of draft units at each side of the spinning frame.

The system of exchanging roving bobbins applied to a ring spinning frame is applied to both sides of the spinning frame in an identical condition. Therefore, the brief explanation of the system of exchanging roving bobbins according to the invention concerns only one side of the spinning frame. In the system of exchanging roving bobbins according to the present invention, first a plurality of full packaged roving bobbins held by the bobbin hangers of a bobbin carriage, and arranged in twin parallel alignment thereon, are carried to the creel position of the ring spinning frame by introducing the bobbin carriage onto one of two transporting rails of the spinning frame. As already explained, the number of full packaged roving bobbins carried by the bobbin carriage is sufficient for a supply of rovings to all draft units of each side of the spinning frame. Thereafter, rovings from the respective full packaged roving bobbins are introduced to the corresponding units of the spinning frame, and then the spinning operation is started by driving the spinning frame. During the time in which these roving bobbins reach an almost exhausted condition, a number of full packaged roving bobbins identical to the number carried by the first-mentioned bobbin carriage, are carried to the creel position of the ring spinning frame by introducing the bobbin carriage onto the other transportation rail mentioned above, and when the first mentioned full packaged roving bobbins reach an almost exhausted condition, the rovings from these almost exhausted roving bobbins are severed so that free ends of the rovings supplied to the corresponding draft units are created. Immediately after the creation of the free ends of the rovings supplied to the corresponding draft units, these free ends of the rovings are pieced with the corresponding rovings from the second mentioned full packaged roving bobbins, which have been carried to the creel position below the second mentioned transporting rail, and then the above-mentioned bobbin carriage supporting almost exhausted roving bobbins are discharged from the creel position below the first mentioned transporting rail and carried to the roving room. Accordingly, the roving bobbin exchange operation can be carried out very simply and smoothly without stopping the driving of the spinning frame, and even in the case of a need for frequent roving bobbin exchanging operations, such as in the case of a small scale yarn production, the roving bobbin exchange operation can be carried out effectively.

DESCRIPTION OF THE PREFERRED EMBODIMENTS

Figure 1:
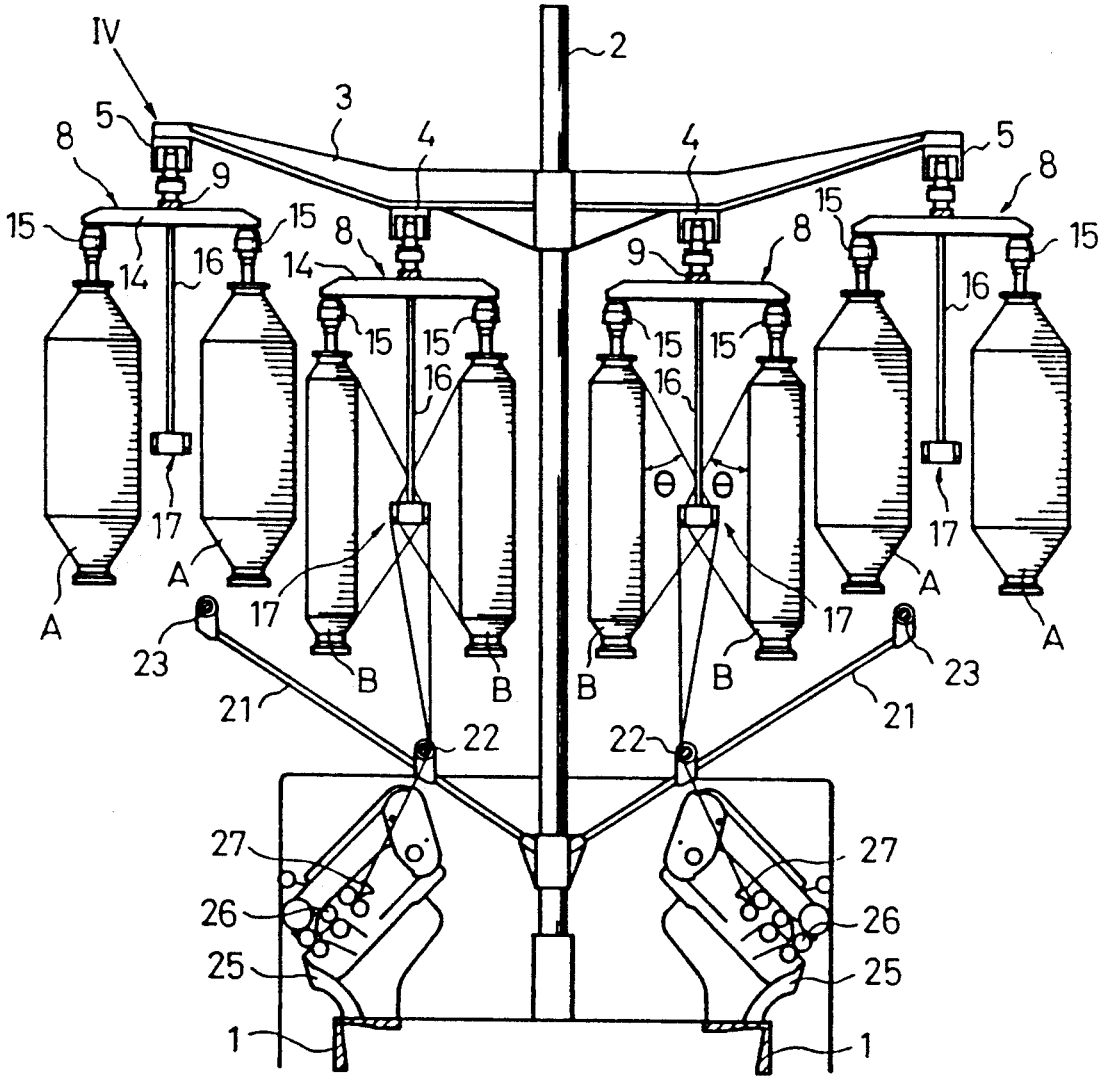
FIG. 1 is a schematic side view of a conventional ring spinning frame except a particular creel mechanism for carrying out the system of exchanging roving bobbins according to the present invention, wherein machine elements other than the creel portion and draft units are omitted.

As shown in FIG. 1, a ring spinning frame, to which the present invention is applied is provided, with a plurality of draft units arranged in an alignment at each side thereof, and a creel mechanism for supporting a pair of bobbin carriages, each provided with a plurality of bobbin hangers, the number of bobbin hangers of each bobbin carriage is identical to the number of the draft units of each side thereof. Therefore, the explanation of the preferred embodiment of the present invention is only directed to the system of exchanging roving bobbins applied to one side of the ring spinning frame.

Figure 4:
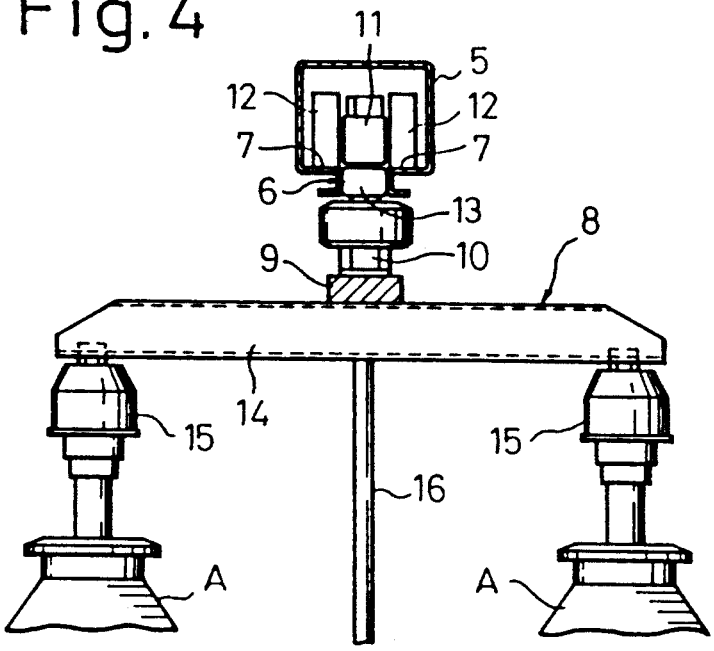
FIG. 4 is an enlarged side view of a portion indicated by an arrow in FIG. 1.

In the ring spinning frame shown in FIG. 1, a plurality of vertical creel pillars 2 are arranged at an equidistant spacing on a machine frame 1, along the longitudinal center line of the machine frame 1, transversely extended supporting arms 3, are mounted at an upper end portion of each creel pillar 2, and a pair of transporting rails 4 and 5 are horizontally arranged along the lengthwise direction of the spinning frame, in parallel with each other. The transporting rail 5, which is arranged at the outer side of the spinning frame, is positioned a little higher than the level of the transporting rail 4 arranged at the inner side of the spinning frame. These two supporting rails 4 and 5 are connected at the terminals thereof with a main transporting rail (not shown) by way of a switch mechanism (not shown) at both sides thereof. The supporting rails 4 and 5 have an identical construction, and therefore, the construction of the transporting rail 5 is mainly explained in more detail with reference to FIG. 4. As shown in FIG. 4, the supporting rail 5 is provided with a main frame portion having rectangular cross section provided with an open mouth formed at the bottom portion thereof, so that a slit 6 is formed along the central line of the bottom portion of the rectangular cross section frame. In the supporting rail 5, a pair of supporting edges 7 are formed at the both sides of the slit 6. The main supporting rail (not shown) has a construction which is substantially identical to that of the supporting rails 4 and 5.

Figure 3:
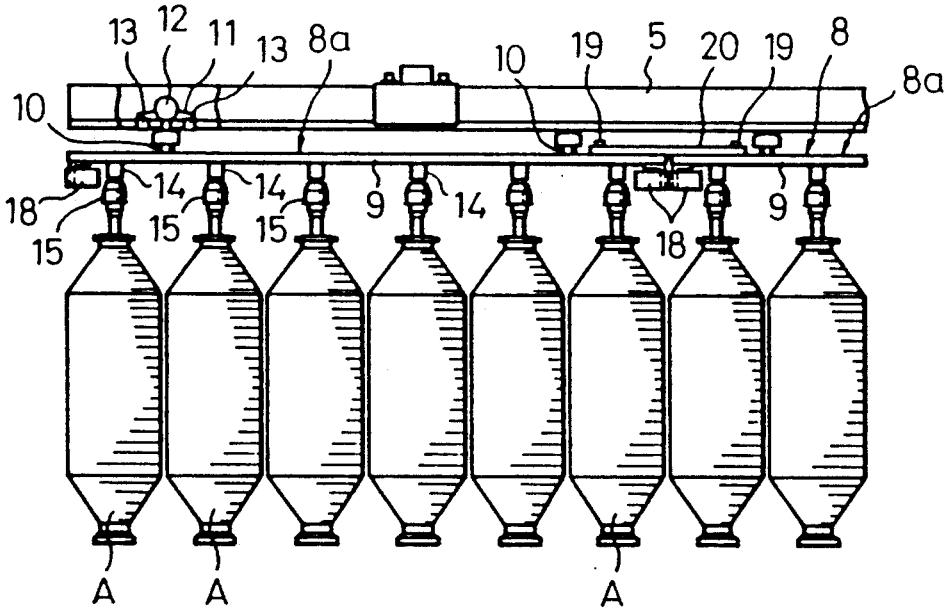
FIG. 3 is a partly omitted front view of the creel position of the ring spinning frame shown in FIG. 1.
Figure 5:
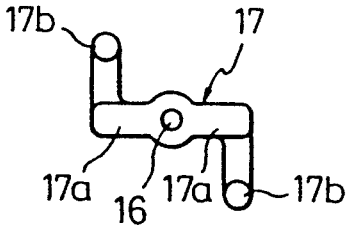
FIG. 5 is a plan view of a roving guide utilized for the ring spinning frame shown in FIG. 1.

The bobbin carriage 8 provided with a plurality of bobbin hangers 15 is displaceably supported by these transporting rails 4 and 5, and the main supporting rail. The bobbin carriage 8 is formed by a predetermined number of carriage elements 8*a*, which are connected such that each two adjacent elements 8*a* can be turned upward or downward, and rightward or leftward, whereby a series of these carriage elements 8*a* is formed. Each carriage element 8*a*, as shown in FIG. 3, is provided with a horizontal carriage bar 9 which extends lengthwise thereof, and a pair of supporting rods 10 rigidly fixed and projected upward from the carriage bar 9 at both ends thereof. A supporting body 11 is rigidly mounted on each of the supporting rods 10 and a horizontal shaft (not shown) is rotatably held by the supporting body 11. A pair of wheels 12 are secured to the above-mentioned horizontal shaft at both ends thereof so that these wheels 12 are able to roll on the corresponding inside surfaces of the respective edges 7 of the transporting rail 5. A roller body 13 is rotatably mounted on the supporting rod 10 in a position such that it is in contact with the inside surfaces of mouth 6 of the transporting rail and rotatable therealong, as shown in FIG. 5. A plurality of supporting frames 14 are secured to the carriage bar 9, with an equidistant spacing between each two adjacent supporting frames 14, such that each supporting frame 14 is horizontally arranged and cross each other. Each supporting frame 14 is formed by a pair of horizontal identical length arms, projected from the carriage bar 9 towards the outsides thereof, and a pair of bobbin hangers 15 are secured to the corresponding ends of each supporting frame 14. (In this embodiment, six supporting frames 14 are secured to each carriage bar 9). Accordingly, in this embodiment, two alignments of bobbin hangers 15 are formed by holding the bobbin hangers 15 at both ends of the six supporting frames 14. The distance between each two adjacent bobbin hangers 15 of each alignment is twice the distance between two adjacent spindles (i.e., a spindle pitch). A vertical supporting rod 16 is secured to the center of each supporting frame 14, such that the supporting rod 16 extends downward, and a roving guide 17 is rigidly mounted on each vertical supporting rod 16 at the bottom end thereof.

Figure 6:
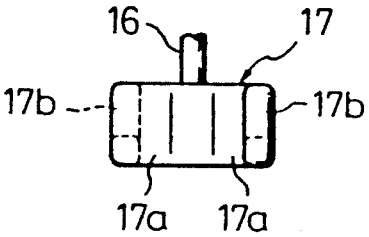
FIG. 6 is a front view of the roving guide shown in FIG. 5.
Figure 7:
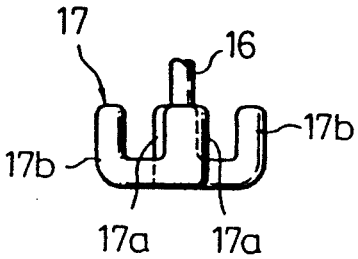
FIG. 7 is a side view of the roving guide shown in FIG. 5.
Figure 8:
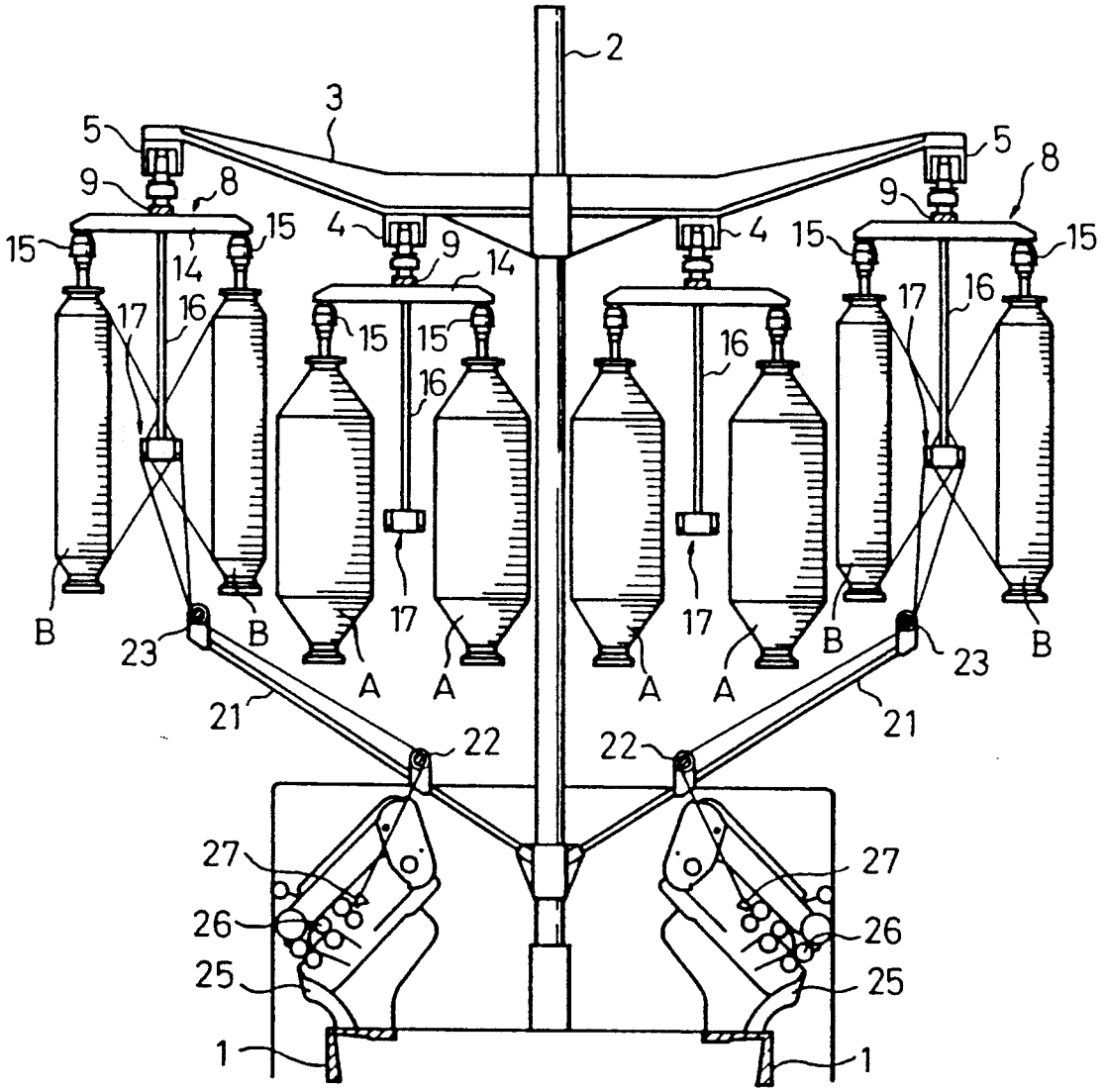
FIG. 8 is a schematic side view of a creel portion of a conventional ring spinning frame, wherein machine parts other than the creel portion and draft units are omitted, for explaining the operational function of the apparatus according to the present invention.
Figure 9:
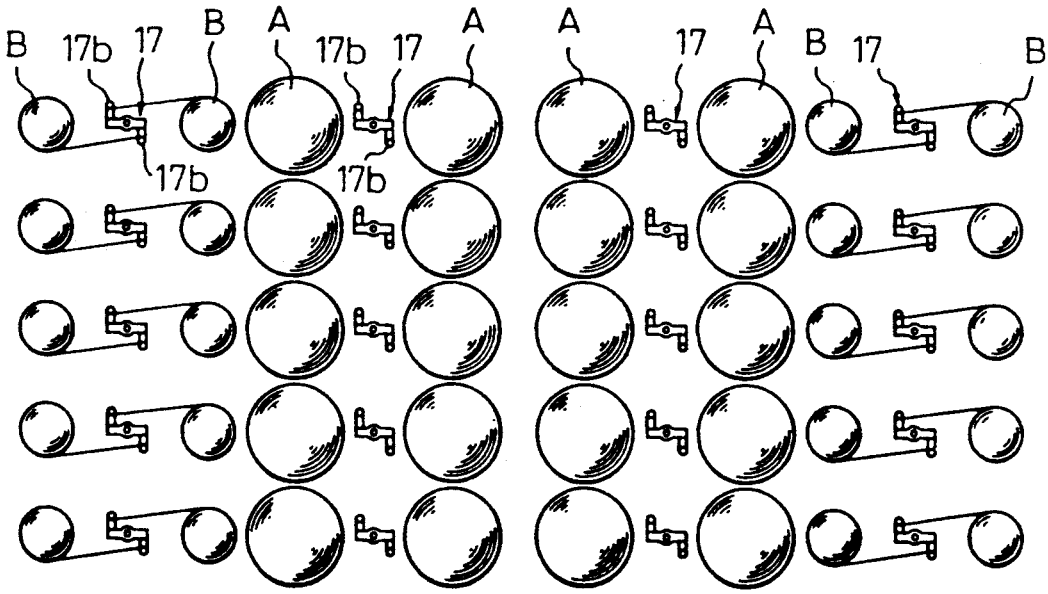
FIG. 9 is a schematic plan view of the relative arrangement of the roving bobbins and the respective roving guides in the ring spinning frame to which the present invention is applied.

In all the drawings other than FIGS. 5, 6 and 7, full packaged roving bobbins are represented by "A" and small packaged roving bobbins are represented by "B", respectively.

As shown in FIGS. 5, 6 and 7, each roving guide 17 is provided with a pair of arms 17*a*, (transversely extending outward from the axial center of the vertical supporting rod 16, and a pair of hook shaped guide portions 17*b* projected in parallel to the alignment of the bobbin hangers 15, so that these hook shaped guide portions 17*b* are projected in opposite directions to each other. Namely, these hook shaped guide portions 17*b* having a certain length are projected from the central axis of the roving guide towards the corresponding roving bobbins held by the respective tow bobbin hangers 15. Since a pair of bobbin hangers 15 are held by the supporting frame 14 at the respective ends thereof, it is clear from the plan view of FIG. 2 that the relative positions of the axial centers of these bobbin hangers 15 are positioned on a straight line passing through the axial center of the vertical supporting rod 16. Therefore, it is clear that the end position of each hook shaped guide portion 17*b* is biased from the above-mentioned straight line, as shown in the plan view of FIG. 2. According to the present invention, each roving taken from a roving bobbin held by the corresponding bobbin hanger 15 is introduced to the corresponding draft unit via the end of the hook shaped guide portion 17*b*, which is located at the side opposite to the hanging position thereof with respect to the vertical supporting rod 16. The position of the roving guide 17 is selected to satisfy a condition such that the tension of a roving taken from each roving bobbin held by the corresponding bobbin hanger 15 of the bobbin carriage 8 supported by the supporting rail 4 (5), to the corresponding draft unit, can be maintained within a predetermined condition. The angle between the roving taken from a full packaged roving bobbin held by the corresponding bobbin hanger 15 and introduced to the roving guide 17, and an outer profile of the roving bobbins is represented by $\theta$ in FIG. 1. A member 18 functioning as a shock absorber is disposed at each end of the carriage bar 9, as shown in FIG. 3. Two adjacent carriage elements 9*a* of the carriage bar 9 are connected at the end portions thereof facing each other by a connecting member 20, in such way that each one of the carriage elements 9*a* is rotatably connected to the connecting member by a vertical pin-like connecting rod 19, and thus the carriage element 9*a* can be turned about the connecting rod 19. Since a small clearance is provided between the ends of the two carriage elements 8*a*, the members 18 of the carriage elements 8*a* can effectively function as shock absorbers. The number "N" of the carriage elements 9*a* forming the carriage bar 9 is defined such that N is at least the number defined by (number of spindles of one side of the spinning frame)/[(number of bobbin hangers held by each one of the carriage elements)×2, which figure coincides with the number of bobbins aligned with each carriage bar 9)].

The bobbin carriages 8 are displaced between the respective positions above roving frames (not shown) and a creel position of a ring spinning frame which requires the roving bobbin exchange operation, by a suitable driving mechanism or driving apparatus. In this mechanism, a plurality of pairs of feed rollers are arranged such that two rollers of each pair are pressed against the carriage elements (8*a*) from both sides thereof, while rotating, and the distance between each two adjacent pairs of rollers is not longer than the length of the carriage bar 9.

In the embodiment of the present invention, the levels of the supporting rails 4 and 5 are not identical, as shown in FIG. 1. Namely, the position of the transporting rail 5 is a little higher than that of the supporting rail 4 so that, when the bobbin carriages 8 are carried to the respective creel positions defined by these supporting rails 4 and 5, respectively, the alignment of the roving bobbins defined by the bobbin hangers 15 of the bobbin carriage 8 supported by the supporting rail 5 is made a little higher than a position of the alignment of the roving bobbins defined by the bobbin hangers 15 of the bobbin carriage 8 supported by the supporting rail 4.

In the first embodiment of the present invention, it is preferable to design the relative positions of the supporting rails 4 and 5, and the creel pillar 2 with respect to the transverse direction to the ring spinning frame, as follows. Namely, the distance between the supporting rail 4 and the alignments of the creel pillars 2 is made as small as possible so that, when full packaged roving bobbins are held by the respective bobbin hangers 15 of the bobbin carriage 8 supported by the supporting rail 4, any possible interference of the full packaged roving bobbins by the creel pillars 2 can be prevented. Further the distance between two alignments of the bobbin hangers 15 held by the bobbin carriages 8 supported by the supporting rails 4 and 5 is made as small as possible so that, when a bobbin carriage 8 provided with full packaged roving bobbins is supported by one of the two supporting rails 4,5, any possible contact thereof with the small size roving bobbins held by the corresponding bobbin hangers 15 of the other bobbin carriage 8 supported by the other of the supporting rails 4,5, can be prevented. The distance between each of the bobbin hangers 15 facing each other in the transverse direction in each bobbin carriage 8 is made as small as possible so that, when full packaged roving bobbins A are held by the respective bobbin hangers 15 of the two alignments thereof, any possible interference between the roving guide 17 and the full packaged roving bobbins can be prevented. Further, the position of the supporting rail 5 must satisfy the condition that, when the bobbin carrier 8 provided with full packaged roving bobbins is moved thereto, the outside profiles of the full packaged roving bobbins positioned outermost along the alignment do not project too far from the front surface of the ring spinning frame.

A supporting arm 21 is mounted on the respective creel pillars 2, and a pair of guide bars 22 and 23 are mounted on the supporting arms 21 such that these guide bars 22 and 23 are located at the respective positions almost immediately below the supporting rails 4 and 5, respectively. These roving guide bars 22 and 23 are extended along the longitudinal direction of the ring spinning frame, in parallel with each other, to cover all draft units of the respective sides of the spinning frame so that the rovings from the respective roving bobbins to the corresponding draft units, each provided with a draft roller 26, a trumpet 27 and a roller stand 25, are guided.

Figure 2:
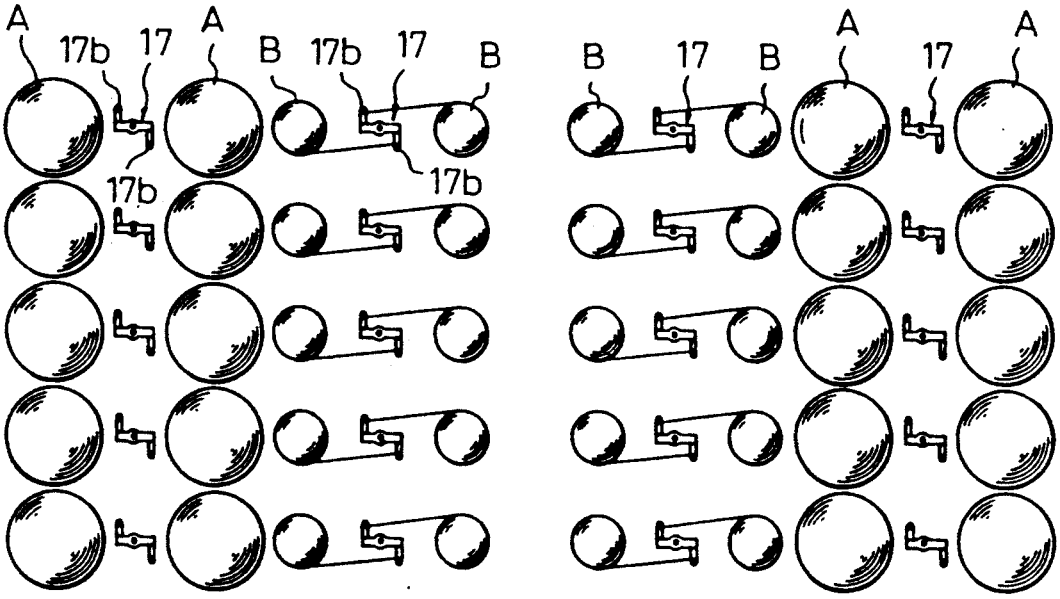
FIG. 2 is a plan view showing the arrangement of roving bobbins positioned at the creel portion of the ring spinning frame shown in FIG. 1.

In the embodiment of the system of exchanging roving bobbins according to the present invention, before starting the spinning operation, the following preparation are necessary. Namely, after hanging full packaged roving bobbins on the respective bobbin hangers 15 in two alignments of the bobbin carriage 8 at the place where the roving frames are installed, this bobbin carriage 8 is displaced to the supporting rail 4 or 5 of a spinning frame which needs the roving bobbin exchange operation, and then the position of the bobbin carriage 8 is regulated to a correct working position of the creel position where the full packaged roving bobbins take the respective correct positions facing the corresponding draft units. These full packaged roving bobbins are then rewound a little, so that rovings to be introduced into the corresponding draft units are created, and these rovings are then threaded into the corresponding roving guide portions 17*b*, respectively, and introduced into the respective trumpets 27 of the corresponding draft units after passing over the roving guide bar 22, step by step and the spinning operation is commenced. During the time in which the above-mentioned full packaged roving bobbins held by the bobbin carriage 8 supported by the supporting rail 4 reach a small packaged conditions, as shown in FIGS. 1 and 2, another bobbin carriage 8 holding full packaged roving bobbins is displaced to the other supporting rail 5, and the position of the bobbin carriage 8 is regulated to the correct creel position so that each of these full packaged roving bobbins is placed at a working position facing the corresponding draft unit.

After completion of the above-mentioned operation of placing the bobbin carriage 8 so as to arrange at the full packaged roving bobbins in the working position, when the roving bobbins of the bobbin carriage 8 supported by the supporting rail 4 reach an almost exhausted condition, the following unit piecing operation of the rovings is carried out in series from the draft unit positioned at the end of the gear-end side or the out-end side to the draft unit of the other end of the spinning frame, step by step. Each unit piecing operation of the rovings is carried out in the following manner. Namely, the roving supplied from a roving bobbin of the bobbin carriage 9 supported by the supporting rail 4 is severed at a position upstream of the guide bar 22 or 23, while being supplied to the corresponding draft unit, so that a free end of the roving is supplied to the draft unit. On the other hand, a full packaged roving bobbin of the bobbin carriage 8 supported by the supporting rail 5, which faces the almost exhausted roving bobbin of the bobbin carriage supported by the supporting rail 4, is rewound so that a free end portion of the roving from the full packaged roving bobbin is created, this roving is then threaded into the corresponding thread guide 17 and the guide bar 23, and the free end of the roving from the full packaged roving bobbin is pieced with the free end of the roving supplied to the corresponding draft unit. The above-mentioned unit operation is carried out at each combination of the respective roving bobbins facing each other, as mentioned above, step by step.

According to the above-mentioned operation, the rovings are supplied from the respective full packaged roving bobbins of the bobbin carriage 8 supported by the supporting rail 5, to the corresponding draft units via the respective trumpet 27. As already explained, when the roving bobbins are held by the bobbin carriage 8 supported by the supporting rail 5, since the distance between the alignment of the roving bobbins at the front side of the spinning frame and the longitudinal center of the spinning frame is as small as possible, by utilizing the roving bobbin guide having a particular shape, any possible interference between rovings during the spinning operation can be prevented, and any possible creation of an irregular draft of the rovings between the roving bobbins of the front alignment to the respective draft units can be prevented.

After the spinning operation has been carried out for a certain time, i.e., until the size of the roving bobbins of the bobbin carriage 8 supported by the supporting rail 5 becomes almost exhausted, the bobbin carriage 8 supported by the supporting rail 4 is displaced from the creel position of the ring spinning frame to the room wherein the roving frames (not shown) are installed. During this displacing operation of the bobbin carriage 8, the roving bobbins held by the bobbin carriage 8 are subjected to a stripping operation by a roving stripper (not shown). On the other hand, instead of displacing the bobbin carriage 8 to the roving frames room, the other bobbin carriage 8 provided with full packaged roving bobbins already held by the respective bobbin hangers 15 thereof, is introduced onto the supporting rail 4 of the ring spinning frame, regulated to the correct working position at the creel portion, where the respective full packaged roving bobbins are correctly positioned facing the corresponding draft units, respectively. When the bobbin carriage 8 having the almost exhausted roving bobbins is displaced to the working position of the roving stripper, since the free end portion of the rovings from the almost exhausted roving bobbins are hung on one of the guide portions 17*b* of the corresponding roving guide 17, a possible dropping the free end portion of any one of the almost exhausted roving bobbins can be prevented.

When the roving bobbins held by the bobbin hangers 15 of the bobbin carriage 8 supported by the transporting rail 5 reach the almost exhausted condition, the above-mentioned unit operation of exchanging roving bobbins is carried out from the draft unit positioned in the proximity of the gear end or the out end of the spinning frame, to the draft unit positioned at the other end of the spinning frame, step by step. Namely, in each unit operation, a roving from the almost exhausted roving bobbin is severed at the position between the corresponding roving guide 17 and the roving guide bar 23, so that a free end of the roving being supplied to the draft unit is created, while a full packaged roving bobbin A held by the bobbin carriage 8 supported by the supporting rail 4, which faces the above-mentioned almost exhausted roving bobbin B, is unwound so that a free end portion of the roving from this full packaged roving bobbin A is created, and immediately after hanging the free end portion of the roving from the full packaged roving bobbin A on the corresponding roving guide 17, the free end of the roving being supplied to the corresponding draft unit is pieced with the free end of the roving from the full packaged roving bobbin A.

Consequently, the rovings from the roving bobbins held by the bobbin carriage 8 supported by the supporting rail 4, are supplied to the corresponding draft unit via the respective trumpets 27. The above-mentioned roving bobbin exchanging operation is repeated without stopping the driving of the spinning frame. Namely, the roving bobbin exchange operation can be carried out simply and rapidly during the continuous spinning operation. In the normal spinning operation, the above-mentioned roving bobbin exchange operation is applied to both sides of the ring spinning frame simultaneously.

Figure 10:
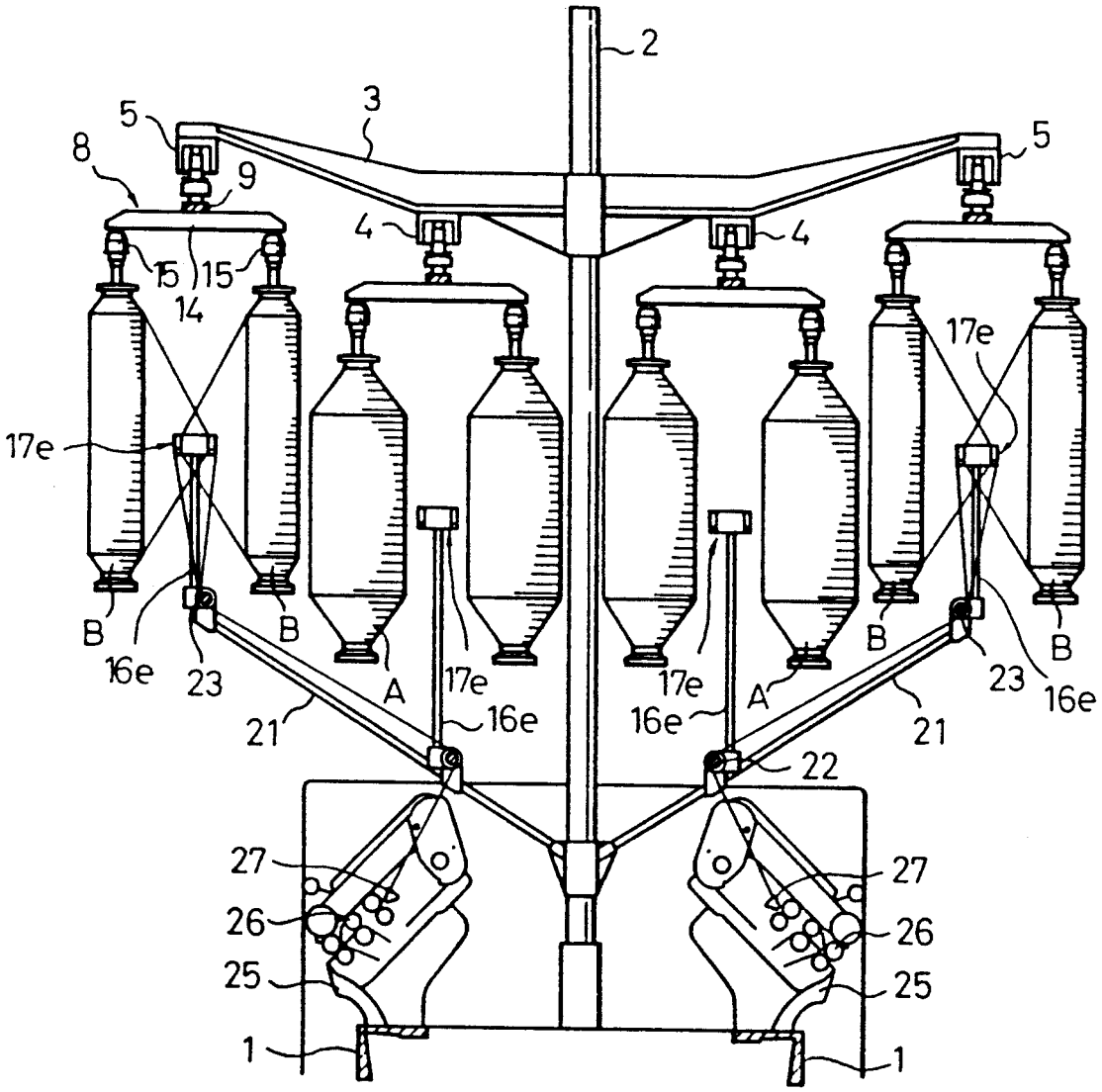
FIG. 10 is a schematic side view of a creel portion of the conventional ring spinning frame, wherein machine parts other than the creel portion and the respective draft units are omitted, for explaining another embodiment of the roving guides.

The creel portion of the spinning frame shown in FIG. 10 shows a modification of the roving guide thereof shown in FIG. 1. Namely, instead of disposing the roving guide 17 on the vertical supporting rod 16 secured to the supporting frame 14 of the bobbin carriage 8, as shown in FIG. 1, a pair of roving guides 17*e* are mounted on respective supporting rods 16*e* which are rigidly secured to respective supporting arms 16*e* such that each of the roving guides 17*e* takes a position like the position of the roving guide 17 shown in FIG. 1. Since, as shown in FIG. 10, the roving guide 17*e* is not mounted on a solid element connected to the roving guide, the construction of the roving guide is simplified. In FIG. 10, for the sake of an easy understanding, machine elements having identical functions to the machine elements of the embodiment shown in FIG. 1, are indicated by identical reference numerals, respectively.

In the modification of the first embodiment, wherein four supporting rails are arranged a plurality of bobbin carriage having the bobbin hangers in one alignment can be applied such that the bobbin carriage can be displaceably supported on each of the supporting rails.

In this specification, only an explanation of the roving bobbin exchanging operation as applied to one side of the spinning frame is given, but in practical operation in the spinning factory, it is usual to apply this operation successively to both sides of the spinning frame at the same time.

In a particular case of a small scale production wherein several different kinds of yarn are to be produced however, the roving bobbin exchange operation can be applied to each side of the spinning frame independently.

As mentioned above, in the present invention, since a bobbin carriage having a plurality of full packaged roving bobbins in introduced onto one of the supporting rails of a ring spinning frame, after discharging another bobbin carriage having almost exhausted roving bobbins from the identical supporting transporting rail, during a period that rovings are supplied from the respective roving bobbins, which are held by another bobbin carriage supported by the other supporting rail, when the roving bobbins held on the second mentioned bobbin carriage reach an almost exhausted condition, the unit operation of exchanging roving bobbins, as explained in the above-mentioned embodiment is successively carried out between one of the full packaged roving bobbins of the first mentioned bobbin carrier and a corresponding one of the almost exhausted roving bobbins of the second mentioned bobbin carrier, from the side of gear end or out end to the other end of the spinning frame at one time. Namely, the roving bobbin exchange operation can be carried out at one time without stopping the driving of the spinning frame, and therefore, the productivity of the spinning frame can be improved.

Another advantage of the present invention is that, since the operation of exchanging the roving bobbins is necessary when the kind of product yarn is changed, the roving bobbin exchange operation can be carried out easily, because the arrangement of roving bobbins in a taper effect is not applied in the present invention. Accordingly, even when producing several different kinds of yarn on a small scale, the roving bobbin exchange operation according to the present invention can be rapidly applied. In such a case of carrying out a small scale production, the above-mentioned roving bobbin exchange operation can be carried out at each side of the ring spinning frame at different times, independently.

A further advantage of the present invention is that when it is necessary to exchange almost exhausted roving roving bobbins of the creel position of the spinning frame with the full packaged roving bobbins, with respect to identical bobbin hangers positioned at the creel position it is unnecessary to use special equipment to carry out the above-mentioned operation.

As disclosed in the explanation of the embodiment of the present invention, a particular object of this invention is prevent any possible creation of an irregular draft between the roving bobbins of the alignment thereof positioned at the outermost side in the spinning frame and the corresponding draft units to which the roving is being supplied. This problem is effectively solved by positioning the outer side supporting rail in such a manner that the distance between the the above-mentioned alignment of the roving bobbins and the lengthwise center of the spinning frame is as small as possible, by utilizing a particular shaped roving guide by which any possible interference between rovings during the spinning operation can be prevented.

We claim:

1. A method for exchanging roving bobbins applied to a ring spinning frame in a spinning room wherein a plurality of spinning frames are installed, in combination with a system for transporting said roving bobbins between said spinning room and a roving room having a plurality of roving frames installed therein, wherein said spinning frame is provided with a plurality of draft parts arranged at each side thereof and a creel portion for positioning roving bobbins at a position above said arrangement of said draft parts, said roving bobbin transporting system utilizes a plurality of roving bobbin carriages, for holding roving bobbins from which rovings are applied to respective draft parts at each side of said spinning frame when said bobbin carriage is transported to a working position thereof at said creel portion of said spinning frame, said method comprising:

providing a number of said roving bobbin carriages, each provided with two parallel alignments of said bobbin hangers arranged along a lengthwise direction thereof, such that a number of said bobbin hangers of each alignment of said bobbin carriages is equal to half of the number of said draft parts arranged along an entire length of one side of said spinning frame, arranging first and second supporting passages in parallel at a position right above said creel portion of each side of said spinning frame along the lengthwise direction thereof, said first passage for supporting a first one of said bobbin carriages and said second passage for supporting a second one of said bobbin carriages, introducing a first bobbin carriage, supporting full packaged roving bobbins by said bobbin hangers, to either one of said two supporting passages, by way of said roving bobbin transporting system, while a second bobbin carriage having roving bobbins, from which rovings are supplied to a corresponding one of said draft parts, is supported by the other of said supporting passages, first carrying out said roving bobbin exchange operation between said full packaged roving bobbins of said first bobbin carriage and subsequently carrying out a roving bobbin exchange operation with a corresponding one of said roving bobbins of said second bobbin carriage when said roving bobbins of said second bobbin carriage reach an almost exhausted condition after creating a tail end of a roving being supplied to a corresponding one of said draft parts by cutting said roving from a corresponding one of said almost exhausted roving bobbin, and piecing said tail end of said roving with a leading end of a corresponding one of said full packaged roving bobbin supported by a fresh one of said bobbin carriages, moving said second bobbin carriage by way of said roving bobbin transporting system, back to said roving room while said first bobbin carriage is supplying rovings to said draft parts, wherein a unit operation of introducing said first bobbin carriage to one of said supporting passages in combination with said roving bobbin exchange operation is alternately applied to said two supporting passages without stopping the production of said spinning frame.

2. A method for exchanging roving bobbins in a ring spinning frame according to claim 1, wherein said roving bobbin exchange operation involves a roving piecing operation between said rovings supplied to said draft part from said roving bobbins of said second bobbin carriage with a free end of rovings form a corresponding one of said full packaged roving bobbins suspended by said first bobbin carriage each time said unit operation for exchanging roving bobbins is carried out.

3. A method for exchanging roving bobbins in a ring spinning frame according to claim 2, wherein said roving bobbin exchange operation applied to each side of said ring spinning frame is carried out at a same time at both sides thereof.

4. A method for exchanging roving bobbins in a ring spinning frame according to claim 2, wherein said roving bobbin exchange operation applied to each side of said ring spinning frame is carried out at different times and independently.

* * * * *